US008317315B2

(12) United States Patent
Hoover et al.

(10) Patent No.: US 8,317,315 B2
(45) Date of Patent: Nov. 27, 2012

(54) CORRUGATED PRE-CURLER FOR MEDIA HOLD-DOWN TRANSPORT

(75) Inventors: Linn C Hoover, Webster, NY (US); Ruddy Castillo, Briarwood, NY (US); Joannes N M Dejong, Hopewell Junction, NY (US); Ming Yang, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 296 days.

(21) Appl. No.: 12/731,162

(22) Filed: Mar. 25, 2010

(65) Prior Publication Data

US 2011/0234724 A1 Sep. 29, 2011

(51) Int. Cl.
*B41J 2/01* (2006.01)

(52) U.S. Cl. ..... 347/104; 347/101; 347/102

(58) Field of Classification Search ..... 347/102
See application file for complete search history.

(56) References Cited

U.S. PATENT DOCUMENTS

| | | | | |
|---|---|---|---|---|
| 4,134,781 | A * | 1/1979 | Carstens et al. | 156/64 |
| 4,314,868 | A * | 2/1982 | Hirakawa et al. | 156/207 |
| 5,527,408 | A * | 6/1996 | Allen | 156/64 |
| 5,837,974 | A * | 11/1998 | Sissons et al. | 219/388 |
| 6,113,981 | A * | 9/2000 | Ogilvie et al. | 427/223 |
| 6,536,894 | B1 * | 3/2003 | Rasmussen et al. | 347/104 |
| 7,486,420 | B2 | 2/2009 | McCrea et al. | |
| 7,538,299 | B2 | 5/2009 | Spence et al. | |
| 2004/0246325 | A1 * | 12/2004 | Sekiya | 347/104 |
| 2006/0221106 | A1 * | 10/2006 | Mataki | 347/10 |
| 2008/0002011 | A1 * | 1/2008 | Mizutani et al. | 347/104 |
| 2008/0204538 | A1 * | 8/2008 | Kovacs et al. | 347/102 |

FOREIGN PATENT DOCUMENTS

| | | | |
|---|---|---|---|
| JP | 2003231244 | A * | 8/2003 |
| JP | 2007076175 | A * | 3/2007 |

OTHER PUBLICATIONS

U.S. Appl. No. 11/955,456, filed Dec. 13, 2007, and entitled "Method and Apparatus for Enhanced Sheet Hold Down on an Imaging Transport" by Castillo, et al.
U.S. Appl. No. 12/471,778, filed May 26, 2009, and entitled "Ink Jet Printing Depth of Focus Control Apparatus" by Bober, et al.

* cited by examiner

*Primary Examiner* — Stephen Meier
*Assistant Examiner* — Leonard S Liang

(57) ABSTRACT

A system for maintaining depth of focus in an ink jet printer between a series of print heads and corrugated media includes a vacuum transport in combination with a heating element positioned upstream of the series of print heads in order to help the vacuum transport acquire the corrugated media and seal edges of the corrugated media against a platen.

20 Claims, 3 Drawing Sheets

CORRUGATED PRE-CURLER FOR MEDIA HOLD-DOWN TRANSPORT

Cross-reference is hereby made to commonly assigned and U.S. application Ser. No. 11/955,456 filed Dec. 13, 2007, and entitled "Method and Apparatus for Enhanced Sheet Hold Down On An Imaging Transport" by Castillo, et al., now abandoned and Ser. No. 12/471,778, filed May 26, 2009, and entitled "INK JET PRINTING DEPTH OF FOCUS CONTROL APPARATUS" by Bober, et al., now U.S. Pat. 8,087,773. The disclosures of the heretofore-mentioned applications are incorporated herein by reference in their entirety.

This disclosure relates to media handling systems, and more specifically, to an improved method and apparatus for enhancing hold-down of corrugated media on a vacuum transport while passing through the print zone of an ink jet printer.

Flexographic printing as shown, for example, in U.S. Pat. No. 7,486,420 is the major process used to print packaging materials. Flexography is used to print corrugated containers, folding cartons, corrugated board displays, multi-wall sacks, paper sacks, plastic bags, milk cartons, disposable cups and containers, labels, etc. In the typical flexographic printing sequence, the substrate is fed into a press from a roll or pre-cut board. The image is printed as the substrate is pulled through a series of flexographic cylinders, or stations, or print units. Each print unit is printing a single color. Unlike traditional cylinder based ink transfer technologies for printing of corrugated materials, such as, Flexography, digital ink jet printing does not contact the substrate and requires that the corrugated media be held flat and be precisely spaced from the print head plane throughout the entire print zone. Depths of Focus (DoF) gaps of the order of 1.0±0.2 mm are typical and they are difficult to achieve and maintain across a large area. Variations in this critical gap cause Time of Flight errors in pixel placement onto the moving media and degrade image quality. Since corrugated material is quite stiff (about 100 times that of typical office papers) any residual curl in boards of the material is difficult to suppress over a large area. In digital ink jet printing of corrugated material, the print zone area is measured in square feet and not a narrow band of a few square inches as with a Flexographic cylinder. Suppressing the curl and holding the corrugated boards flat to within +/−200 μm is a challenge.

The composite structure of corrugated board consists of an inner liner, corrugated medium and an outer liner glued together at the peaks of the corrugated medium which gives corrugation its strength and stiffness. The paper fiber orientation is in the machine direction for both inner and outer liners and medium. The fiber orientation provides greater board stiffness and lower shrink rate versus moisture content in the machine direction. In conventional media vacuum transport systems the challenging areas are the sheet edges, due to leakage as the vacuum is exposed to ambient.

Typically, Flexography corrugated board direct print systems employ a soft elastomer print pad mounted on a rotating drum. The pad is coated with ink and pressed against the corrugated board to transfer the image. The print pads are not continuous around the circumference of the drum so Flexography presses, in most applications, use mechanical grippers to constrain the lead and trail edges of the board or vacuum hold-down elements. Replacing the Flexographic printing process with solid or gel ink jet heads requires maintaining a gap of less than 1 mm between the corrugated board and print heads and holding the entire board flat to within +/−200 μm to achieve acceptable image quality. Mechanical grippers cannot maintain the flatness specification over the entire board surface. A vacuum transport belt offers a simple and effective way to hold and transport the board under the print head without gripping the board's top surface. Corrugated stiffness is greater than 100 times that of typical office papers, therefore, the required vacuum force to hold-down an up-curled board is significantly higher. As a result of the high vacuum pressure, a large drag force (between the transport belt and the vacuum platen) is generated, which in turn makes it difficult to drive the hold-down transport belt. The large drag forces induce variations in the transport belt motion relative to the print heads that cause spatial errors between the ink dot placement on the board resulting in banding and other image defects.

One attempt at media conditioning is shown in copending U.S. application Ser. No. 11/955,456 cited hereinabove that discloses a precurling method for improving paper hold-down on a drum or belt. In another example, U.S. Pat. No. 7,538,299 B2 shows a media conditioning module for conditioning sheets that comprises a heater and a cooler to apply heated and cool air to both sides of media en route to an image transfer station.

In answer to these problems and disclosed herein is the use of heat applied to the underside of a corrugated board to drive moisture out of an inner liner of the board, thereby causing it to shrink and pull a flat board into a concave arch. The edges of a board with up curl will be pulled down flattening the board or reversing the curl and pulling the board into a concave arch depending on the amount of up curl and moisture loss. By heating the underside of the corrugated board prior to transferring it onto a vacuum transport, edges of the board will curl down and remain curled until the inner liner absorbs moisture from the ambient environment and equilibrates back to its original moisture content and shape. The corrugated board paper fiber orientation previously described causes the board to curl more in the cross machine direction compared to the machine direction. The cross machine direction curl generated can be 10× greater than the machine direction curl depending on the media properties, flute size and initial moisture content or the corrugated board.

A board with up curl has a convex shape. The edges are cantilevered from the center of the board. Vacuum pressure must overcome the flexural stiffness of the board to pull the edges down against the transport belt. The up curled edges result in large air leakage and reduced vacuum pressure at the edges. Increasing the vacuum pressure to compensate for the losses at the edges results in higher pressures and drag forces at the center of the board. A concave board is simply supported at the edges. The flexural stiffness of the board works with the vacuum pressure to hold the edges of the board against the transport belt sealing the perimeter of the board and distributing vacuum evenly over the entire surface of the board. Thus, less vacuum pressure translates to lower friction between the transport belt and a platen enabling a smaller drive torque and improved motion quality to move the board and belt under a series of print heads.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
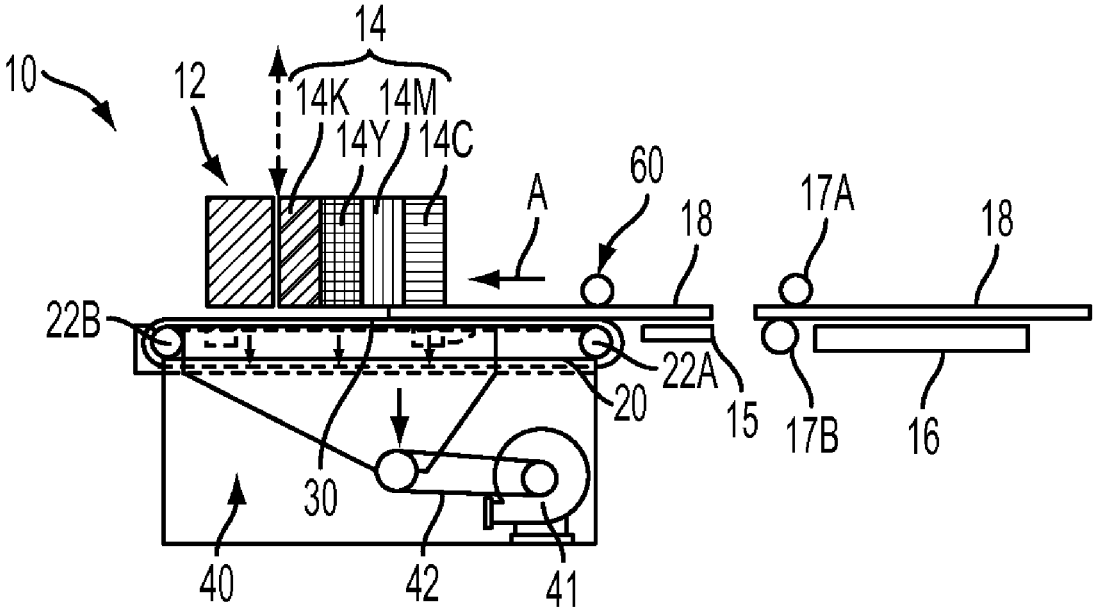
FIG. 1 is a partial schematic side view of an ink jet printer apparatus that incorporates a pre-curler for corrugated boards in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment ink jet printing apparatus that includes a method and apparatus that pre-curls corrugated boards prior to transport through a printing zone.

For a general understanding of the features of the disclosure, reference is made to the drawings. In the drawings, like reference numerals have been used throughout to identify identical elements.

Referring now to printer 10 in FIG. 1, the ink jet printer 10 includes an ink jet recording head 14 disposed above a conveyor belt 20. The ink jet recording head 14 is configured to be long, such that its effective recording area is equal to or greater than the cross process width of corrugated board 18. The ink jet recording head 14 includes four ink jet modules 14C, 14M, 14Y, 14K, which respectively, correspond to the four colors cyan (C), magenta (M), Yellow (Y), and black (K). If desired, the recording head 14 can contain multiple modules to print CMYK plus white, custom colors or UV overcoat. The ink jet modules 14C, 14M, 14Y, 14K includes staggered print heads that are disposed along the conveyance direction; thus, the ink jet recording head 14 can record a full-color image. If UV curable inks are used, an ultraviolet curing station 12 is positioned downstream of the recording head.

The recording section adjacent the recording head includes an endless conveyor belt 20 that includes a number of small holes (not shown) therein and wound around a drive roller 22B disposed downstream in the paper conveyance direction A and a driven roller 22A disposed upstream in the paper conveyance direction A. The conveyor belt 20, which could be woven and/or porous, etc., is configured such that it is circulatingly driven by the drive and driven rollers. A vacuum plenum 40 is connected through conduit 42 to a vacuum source 41 and adapted to apply vacuum pressure to the holes in conveyor belt 20 in order to attach corrugated board 18 to the belt 20 sliding across the vacuum platen 30 during recording by the recording head 14.

The ink jet recording head 14 faces a flat portion of the conveyance belt 20 and this facing area serves as an ejection area to which ink droplets are ejected from the ink jet recording head 14. The corrugated board 18 is retained by the conveyor belt 20 and transported through the ejection region, where the ink droplets corresponding to an image are ejected from ink jet recording head 14 and onto the board 18 in a state where the board 18 faces the ink jet recording head 14.

In order to maintain image quality and DoF between recording head 14 and corrugated boards beneath the recording head as shown in FIG. 1, an acquisition cylinder 60 is positioned upstream of recording head 14 to help acquire control of board 18 and iron it flat against the vacuum belt 20 and vacuum platen 30 surfaces before it enters the print zone, thereby suppressing process and cross process curl. Hold down acquisition cylinder 60 is a statically loaded, floating, low pressure cylinder intended to flatten the lead edge of the board in cross process direction across the plenum platen 30 of vacuum transport 40 to enable lead edge acquisition and to establish a positive drive of the board as it enters the vacuum transport, even before the board has had a chance to be forcibly acquired by the vacuum transport. The board is then held flat by vacuum belt 20 and vacuum plenum platen 30 through the print zone.

Figure 2:
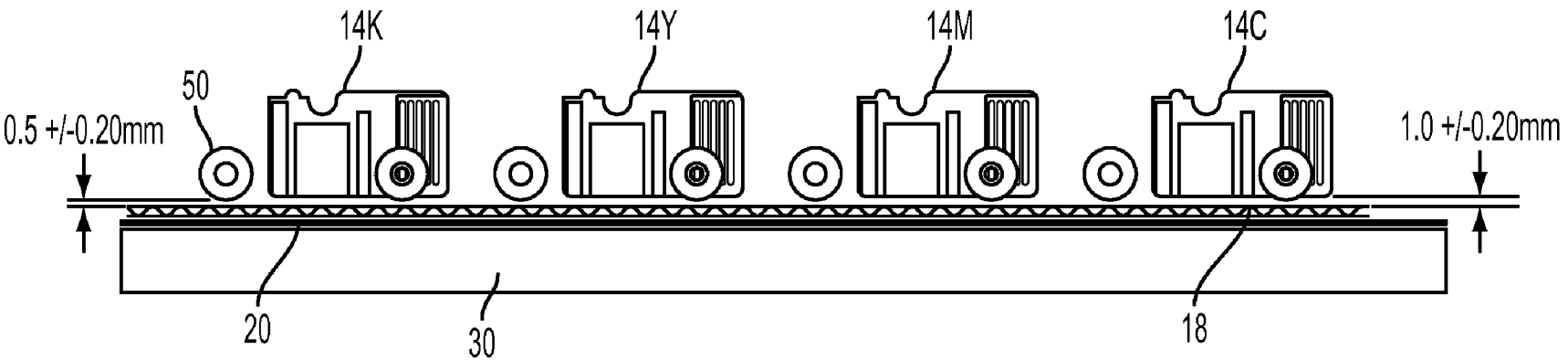
FIG. 2 is a partial schematic side view of the ink jet printer apparatus in FIG. 1 showing star wheels protruding from beneath the series of print head modules.

Protecting the print head modules from board lift-off from the vacuum belt 20 and vacuum platen 30 caused by excessively curved, curled, bowed or distorted board or in the event of loss of vacuum is addressed with a series of star wheels as shown in FIG. 2. Star wheels 50 distributed throughout the print zone that suppress process and cross process curl. Star wheels are commonly used to control media lead and trail edges after image transfer and fusing processes or to guide media immediately following application of liquid ink to prevent image smears (e.g. U.S. Pat. No. 7,086,730). Star wheels can also be used as mechanical hold down mechanisms in the print zone and in close vicinity to liquid ink print heads provided they are low wetting, i.e., made of either of a non-wetting material and coating and of a particular geometry, such as, tapered cylindrical pins. The star wheels are mounted between staggered rows of print head modules 14C, 14M, 14Y and 14K shown in FIG. 2 to protrude below the plane of recording head 14 by a large percentage (~50%) of the nominal DoF gap to control the print head to media gap and to suppress process direction curl.

As mentioned hereinbefore, the composite structure of a corrugated board consists of an inner liner, corrugated medium and an outer liner glued together at the peaks of the corrugated medium which gives corrugation it strength and stiffness. In conventional media vacuum transports systems, the challenging areas are edges of the corrugated board due to leakage as the vacuum is exposed to the surrounding atmosphere. Test results have shown that pre-curling the board (towards the platen) dramatically reduces (by a factor of 9×) the required vacuum force to hold it flat.

Figure 3:
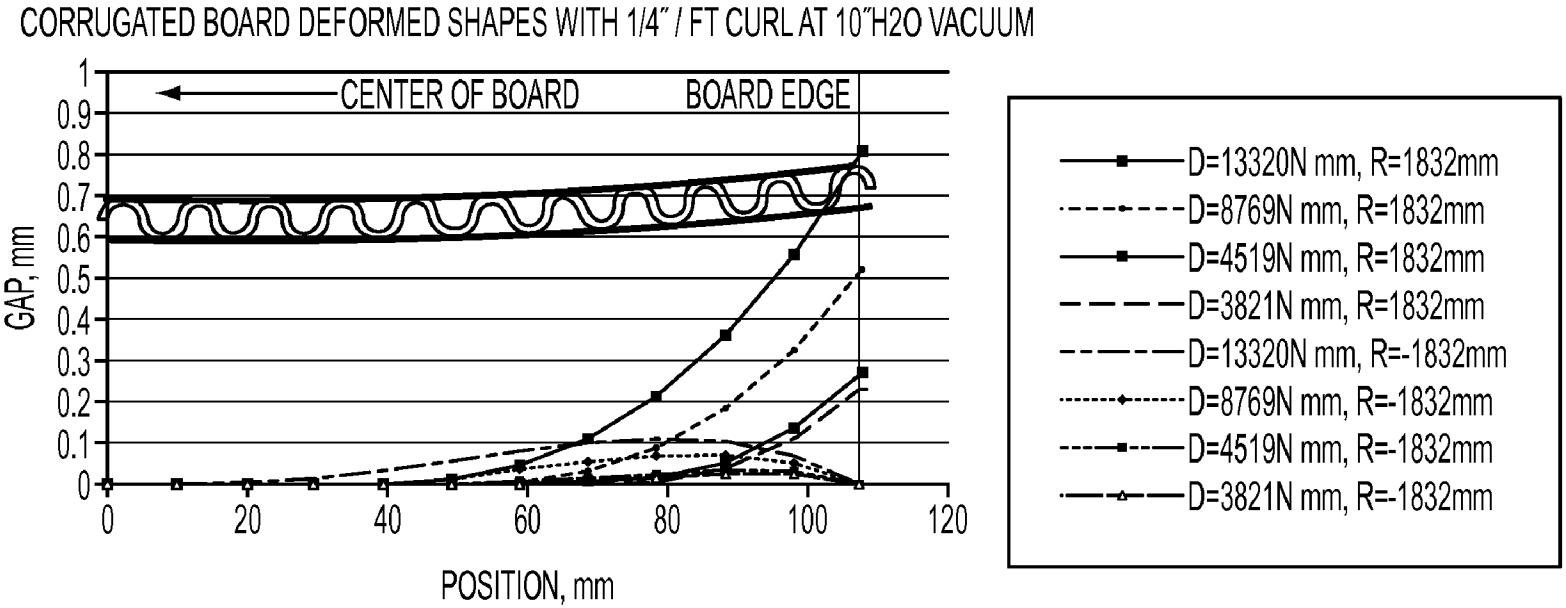
FIG. 3 is a graph showing the FEA results for the gaps between the edge of a corrugated board and vacuum transport belt at 10 inches of vacuum pressure for convex vs. concave board profiles.

FIG. 3 is a graph showing the gap between the edges of four samples of corrugated board and a vacuum belt with 10 inches of water vacuum pressure. The curves with the upward deflection represent corrugated boards with ¼" per foot up curl. The curves with the concave curve represent boards with ¼" per foot down curl. The flexural stiffness for the corrugated samples range from 3821 to 13320 N-mm. The amount of gap is proportional to the board flexural stiffness. Down-curling reduces the vacuum leakage at the edges by sealing off the pressure and using the body stiffness of the board to aid in the hold-down process. In this condition: the edges of the board seal against the belt to minimize air leakage; the vacuum forces are uniform across the entire surface of the board; and the entire surface of the board and the flexural stiffness works with the vacuum to hold the edges flat against the belt. Corrugation boards cannot be pre-curled using conventional office media de-curling methods employing pressure rolls. The rolls would crush and destroy the board's structural properties.

Therefore, in order to improve image quality by maintaining DoF between recording head 14 and corrugated boards beneath the recording head and in accordance with the present disclosure as shown in FIG. 1, heater 15 is positioned upstream of vacuum plenum 40 to help vacuum platen 30 acquire control of board 18 against the vacuum belt 20 and vacuum platen 30 surfaces before it enters the print zone, thereby suppressing process and cross process up-curl. Boards 18 are fed through a nip formed by drive roll 17A and pressure roll 17B. Heat is applied by heater 15 to the under side of the board in order to drive moisture out of the inner liner portion of the board and, as a result, causes it to shrink and pull the board into a concave configuration. By heating the underside of the corrugated board prior to transferring onto vacuum platen 30, the board will curl down and remain curled until the liner equilibrates back to its original moisture content. As a result, sealing of the edges of the board requires less vacuum pressure which translates into lower friction between the vacuum transport belt 20 and platen 30 enabling a smaller drive torque and improved motion quality to move the board and belt under the print heads. Heating of the board could be accomplished with a variety of conventional means, for example; an infrared heating element, hot air, heated platen, microwave, etc.).

Most corrugation feeders feed from the bottom of the stack. Therefore, as an alternative or in addition to heater 15, an auxiliary heating element 16 is shown in FIG. 1 that could be added to the bottom plate of a feeder to pre-heat the board and reduce the amount of heat energy applied between the feeder and vacuum transport by heater 15.

Alternatively, while adding moisture to the top liner will cause it to expand and bend a board 18 down generating down-curl, heating the board is advantageous over adding moisture because the dry bottom liner will have a higher modulus and be in tension compared to the moist top liner which will have lower modulus and in compression. Also, the moist top liner will be prone to puckering resulting in image defects.

Adding moisture to the top liner in low humidity conditions could improve the effectiveness of the heater by reducing the amount of heat energy required to achieve a predetermined delta in percent of moisture content (expansion vs. shrinkage) between the top and bottom liners corresponding to a desired amount of down-curl. Moisture and heat energy would be controlled by humidity sensors or media moisture sensors mounted in the feeder and temperature sensors mounted downstream of the heating element.

It should now be understood that a solution for low frequency DoF control errors in ink jet printing onto corrugated media has been disclosed that includes employing a heating element to heat the bottom side of a corrugated board before the board reaches a vacuum transport which transports the corrugated media to a series of staggered ink jet print head modules positioned over a platen and thereby improve image quality by enhancing the sealing of edges of the board to the platen.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A recording apparatus that conducts image recording onto corrugated recording media within a print zone includes a system for applying a concaved pre-curl to the corrugated recording media and thereby maintaining a constant gap in the print zone between the image recording apparatus and the corrugated recording media, comprising:

a transport module, said transport module including an arrangement for moving the corrugated recording media through said print zone, said corrugated recording media including an inner liner, a corrugated medium and an outer liner glued together at peaks of said corrugated medium;

a down curl producing device positioned upstream of and removed from said transport module and beneath said corrugated recording media to apply heat directly to said inner liner of said corrugated recording media and thereby remove non-ink moisture from said inner liner of said corrugated recording media to produce a concave down curl in said corrugated recording media; and a mechanism positioned upstream of and removed from said transport module that applies non-ink moisture to said outer liner of said corrugated recording media when the moisture content of said corrugated recording media is below a predetermined amount to facilitate the concave down curl and thereby enhance acquisition of said corrugated recording media by said transport module by minimizing a gap between edges of said corrugated recording media and said transport module while simultaneously increasing vacuum pressure at said edges of said corrugated recording media.

2. The ink jet printing apparatus of claim 1, including pre-heating said inner liner of said corrugated recording media before it reaches said down curl producing device.

3. The recording apparatus of claim 1, wherein said transport module utilizes a continuous belt to transport the corrugated recording media.

4. The recording apparatus of claim 1, wherein said heating device is an infrared heating element.

5. The recording apparatus of claim 1, wherein said heating device is a hot air device.

6. The recording apparatus of claim 1, including an auxiliary heating device positioned to heat the corrugated recording media upstream of said down curl producing device.

7. The recording apparatus of claim 1, wherein said heating device is a microwave device.

8. An ink jet printing apparatus that conducts image recording by ejecting ink from a series of print head modules onto corrugated recording media within a print zone including a vacuum transport, said vacuum transport including a belt module having a belt support for supporting a movable continuous belt that conveys the image recording media through the print zone and a vacuum plenum connected to a vacuum source, said vacuum plenum including a plenum plate covering said vacuum plenum and facing an underside portion of said continuous belt such that vacuum pressure can be applied to corrugated recording media carried by said belt module, said ink jet printing apparatus including a system for maintaining depth of focus in the print zone between the print head modules and the corrugated recording media, comprising:

a concave curl producing mechanism positioned beneath said corrugated recording media and adapted to interact directly with said corrugated recording media and apply a concave curl in said corrugated recording media prior to it reaching said vacuum transport, thereby enabling a smaller drive torque drive and improved motion quality to said vacuum transport in moving said corrugated recording media with said continuous belt.

9. The ink jet printing apparatus of claim 8, wherein said concave curl producing mechanism is a heating member.

10. The ink jet printing apparatus of claim 9, including an auxiliary heating member positioned upstream of said heating member.

11. The ink jet printing apparatus of claim 8, wherein said heating member is a heated platen.

12. The ink jet printing apparatus of claim 8, wherein said heating member is a microwave device.

13. The ink jet printing apparatus of claim 8, wherein the corrugated recording media includes an inner liner, corrugated medium, and an outer liner, and wherein moisture is removed from said inner liner of the corrugated recording media.

14. The ink jet printing apparatus of claim 8, including an auxiliary heating device positioned to heat said under side of the corrugated recording media upstream of said heating member.

15. A method for enhancing corrugated recording media acquisition in a recording apparatus that records images onto corrugated recording media within a print zone, said corrugated recording media including an inner liner, a corrugated medium and an outer liner glued to together at peaks of said corrugated medium; comprising:

providing a recording media transport with at least a portion thereof opposite to and within said print zone; and applying a concave curl to said corrugated recording media prior to it reaching said recording media transport by generating a non-ink moisture differential between said outer liner and said inner liner of said corrugated recording media prior to reaching said recording media transport.

16. The method of claim 15, including providing a heating member for heating said inner liner of said corrugated recording media, and providing an auxiliary heating member upstream of said heating member positioned to heat said inner liner of said corrugated recording media.

17. The method of claim 16, including providing a feeder module for feeding said corrugated recording media from a stack to receive images thereon, and wherein said auxiliary heater is positioned beneath said corrugated recording media within said feeder module.

18. The method of claim 17, including positioning at least one humidity sensor within said feeder module.

19. The method of claim 16, including providing said concave curl to said corrugated recording media in a cross recording apparatus direction than in a recording apparatus direction.

20. The method of claim 15, wherein said corrugated recording media concave curl will remain curled until said inner liner absorbs moisture from the ambient environment and equilibrates back to its original moisture content and shape.

* * * * *